United States Patent [19]

Hohmann

[11] 4,006,347

[45] Feb. 1, 1977

[54] SYSTEM FOR A CRANE BOOM

[75] Inventor: Walter Hohmann, Essen-Werden, Germany

[73] Assignee: Kruger & Co. KG, Essen-Werden, Germany

[22] Filed: Jan. 23, 1976

[21] Appl. No.: 651,788

[30] Foreign Application Priority Data

Feb. 4, 1975 Germany ..... 2504455

[52] U.S. Cl. ..... 235/150.2; 340/267 C

[51] Int. Cl.[2] ..... B66C 23/90; G06G 7/70

[58] Field of Search ..... 235/150.2, 151; 340/267 C

[56] References Cited

UNITED STATES PATENTS

| | | | |
|---|---|---|---|
| 3,771,667 | 11/1973 | Berker et al. | 340/267 C |
| 3,841,493 | 10/1974 | Jackson et al. | 340/267 C |
| 3,854,128 | 12/1974 | Yamagishi | 340/267 C |
| 3,870,160 | 3/1975 | Hutchings | 340/267 C |

*Primary Examiner*—Felix D. Gruber
*Attorney, Agent, or Firm*—Karl F. Ross; Herbert Dubno

[57] ABSTRACT

A crane boom, pivoted at one end to the chassis or body of the crane, is swung about a horizontal axis by a hydraulic drive mechanism, e.g. a double-acting piston-and-cylinder arrangement. A control system for this boom comprises a device which monitors the instantaneous load moment on the boom and the maximum load moment permissible for the particular position of the boom (as a function of this position) and compares these two parameters in a quotient-forming comparator whose output is applied to a set point adjusting element via a logic circuit or connection device. The set point generating unit forms part of the actuating system for the crane.

10 Claims, 3 Drawing Figures

SYSTEM FOR A CRANE BOOM

FIELD OF THE INVENTION

The present invention relates to a system for controlling a crane drive and, more particularly, to a method of and an apparatus for controlling the displacement of the boom of a boom-type crane.

BACKGROUND OF THE INVENTION

In a boom-type crane, the boom is pivotally mounted on a chassis or other support structure for swinging movement about a horizontal axis, the load being applied to the free end of the boom through a cable or the like. The system for actuating the boom may include a double-acting piston-and-cylinder arrangement engaging the boom and adapted to swing the latter under the control of a manual element, e.g. a control lever, through a range of angular positions at which the boom includes more or less steep angles with the horizontal.

It will be apparent that a given load applies to the boom a variable load moment depending upon the boom position, the load moment being a function of the downward force times at horizontal distance between the pivot and the point of attack of the downward force. In other words, the horizontal component of the moment at any instant defines the load moment for a given load. As the boom swings upwardly for a given load, the load moment decreases and, conversely, as the boom swings downwardly, the load moment increases.

For each angular position of the boom, the crane (the boom supporting structures and chassis) has a maximum permissible load moment which cannot or should not be exceeded if the danger of breakdown or tipping is to be avoided.

It is not uncommon, therefore, to provide, as part of the crane control system, means for monitoring the loading (i.e. the load moment) applied to a crane boom.

The conventional drive for a crane boom may comprise, as noted, a hydraulic motor such as the double-acting cylinder mentioned previously, which serves as the output element of a servocontrol system whose input element is the manually operated control lever mentioned previously. This element provides a set point value to the control system and the controller causes displacement of the hydraulic motor until the position of the boom corresponding to the set point input is reached.

The load moment monitor is usually independent of this boom-actuating system and generally includes a further system in the form of a switch which is operated when the load moment becomes excessive to cut out undesired further displacement of the boom.

The difficulty with this system, in which independent lockout of the operation of the boom when the instantaneous load moment reaches the maximum permissible load moment, is that it is not responsive to the operator. As a consequence, if the operator should shift the lever into high speed lowering of the boom or another rapid displacement which might tend to overrun the speed with which the monitoring device can act, the boom will nevertheless be shifted past its maximum permissible load moment.

In other words, in order for the conventional device to function effectively, the operator cannot rapidly displace the boom when the monitoring device indicates that the instantaneous load moment is close to the maximum permissible load moment.

When care is not taken, the crane will tip if the maximum permissible load moment is exceeded because the monitoring or cutoff device could not react with sufficient speed.

To avoid this problem it has been proposed to provide an acoustical or optical warning signal which is triggered when the instantaneous load moment approaches the maximum permissible load moment and which further can provide an alert when the maximum permissible load moment reaches high values, i.e. where the danger of tipping or the like is more pronounced. Frequently the warning is not heeded.

OBJECTS OF THE INVENTION

It is the principal object of the present invention to provide a system (i.e. method of and apparatus for) eliminating the disadvantages discussed above and especially eliminating the possibility that, at maximum permissible load moments close to the highest load moments, overloading of the crane boom can occur.

Another object of the invention is to provide an apparatus for controlling the displacement of a crane in which high speed operation of the boom thereof is excluded when the instantaneous load moment is close to the maximum permissible load moment, thereby obviating the possibility of overloading.

Still another object of the invention is to provide a crane drive which is more sensitive and requires less caution on the part of an operator to prevent overloading of a boom-type crane and the tipping thereof.

SUMMARY OF THE INVENTION

I have now found that the foregoing objects can be achieved by producing a continuous output signal which is a function of the ratio of the instantaneous load moment and the predetermined maximum permissible load moment of the boom, namely, the quotient of two signals representing the respective moments, and adjusting the response of the controller to manual setting of the lever in accordance with this signal. This is achieved by having the set-point adjuster, namely, the manual operating lever, connected to the setting body, e.g. a hydraulic valve, regulating the speed of the crane drive, via a logic element or regulator. The term "logic element" is not used here in the sense in which it has been employed in the digital computer arts, to indicate a gate for pulses but rather to represent an intelligence device or controller responding to the abovementioned quotient signal for varying the response of the boom positioning device to the manual operating lever.

According to the invention, therefore, the load moment monitoring device provides an input to the logic element which is disposed in the control chain between the setting lever and the controlled element of the crane drive to effect the response of the latter to the setting lever movements by decreasing the speed of operation of the crane boom automatically with increasing load moment and by increasing the speed of the crane boom with reduction of the load moment, for given displacements of the actuating lever. Upon approach to the maximum load moment, the response gradually reaches zero, thereby preventing overload even with a sharp displacement of the actuating lever when the crane is close to maximum load moment.

The system described has the advantage that the crane can be actuated at the highest possible speeds when there is no danger of overloading and tipping but automatically is confined to low speeds when such danger approaches. Furthermore, it permits an operator to work up to the maximum permissible load moment (maximum loading) without requiring the operator to leave a margin for error and avoid high loadings because of the possibility that a rapid displacement of the control lever may cause overrunning of the maximum load moment and tilting of the crane.

Furthermore, the system increases the useful life of the crane because overloading is completely eliminated and sharp stops and the like can be avoided close to the maximum load moment position of the crane boom.

According to a feature of the invention, the set point element comprises the manually operable control lever and a potentiometer whose wiper is mounted on a pivotal element forming part of or connected to this lever, while the logic element also comprises a potentiometer whose wiper is displaceable by a servomotor in response to the output signal of the monitoring device. The potentiometer of the logic network is connected in a voltage divider circuit with the operating element of the crane boom drive, e.g. an electrically operable valve whose flow cross-section determines the speed at which the boom is displaced.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 3:
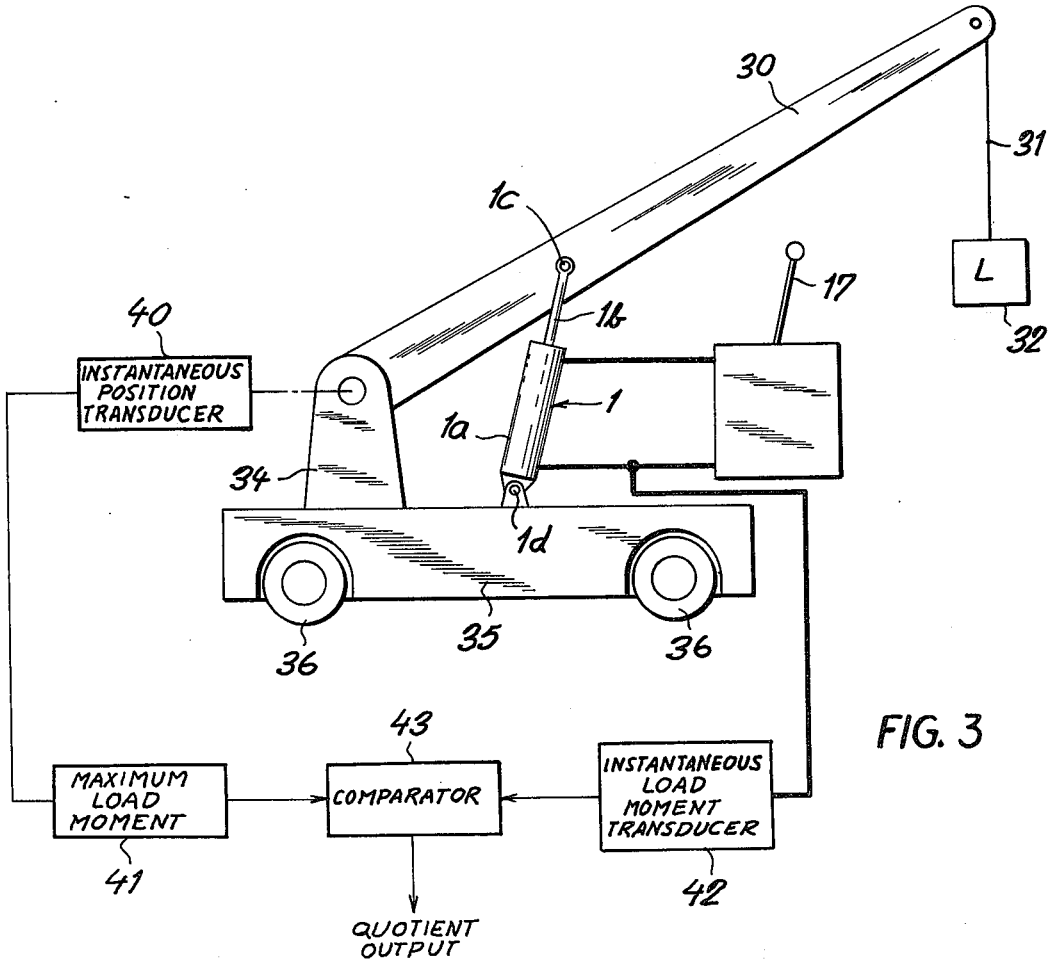
FIG. 3 is a diagrammatic elevational view of a crane showing control elements associated therewith.

Referring first to FIG. 3, it will be apparent that the invention is applicable to any boom-type crane in which, for example, the crane has a boom 30 along which passes a cable 31 from which a load 32 can be suspended. The winch, drums and cable-drive devices for this crane have not been illustrated and are conventional in the art.

The boom 30 can be pivotally mounted at 33 upon a support 34 of a mobile crane chassis 35 whose wheels 36 enable the crane to move from place to place. A turntable or turret can be provided to allow the boom to swing about a vertical axis as well if desired.

The crane is provided with a hydraulic motor 1 in the form of a double-acting cylinder 1*a* whose piston 1*b* is pivotally connected at 1*c* to the boom while the cylinder itself is connected at 1*d* to the chassis. As the piston extends from the cylinder the boom will be swing in a counterclockwise sense as shown in FIG. 3.

For a given load 32, the displacement of the boom toward an upright position in the counterclockwise sense will result in a reduction in the horizontal displacement of the load from the pivot and consequently a reduction in the load moment which is the product of this horizontal component and the gravitational force applied to the load.

Figure 1:
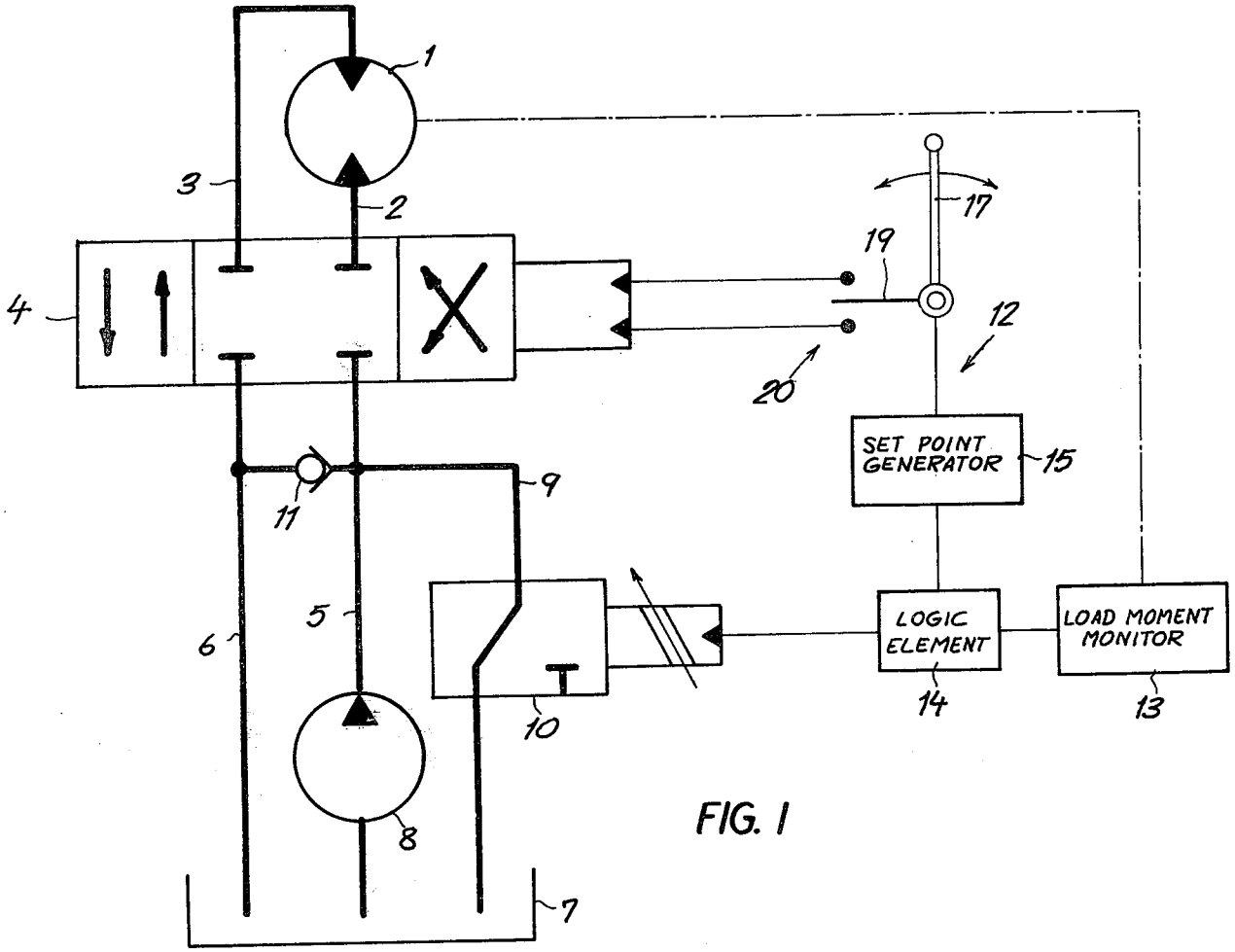
FIG. 1 is a block diagram of a control system according to the present invention of a crane boom.
Figure 2:
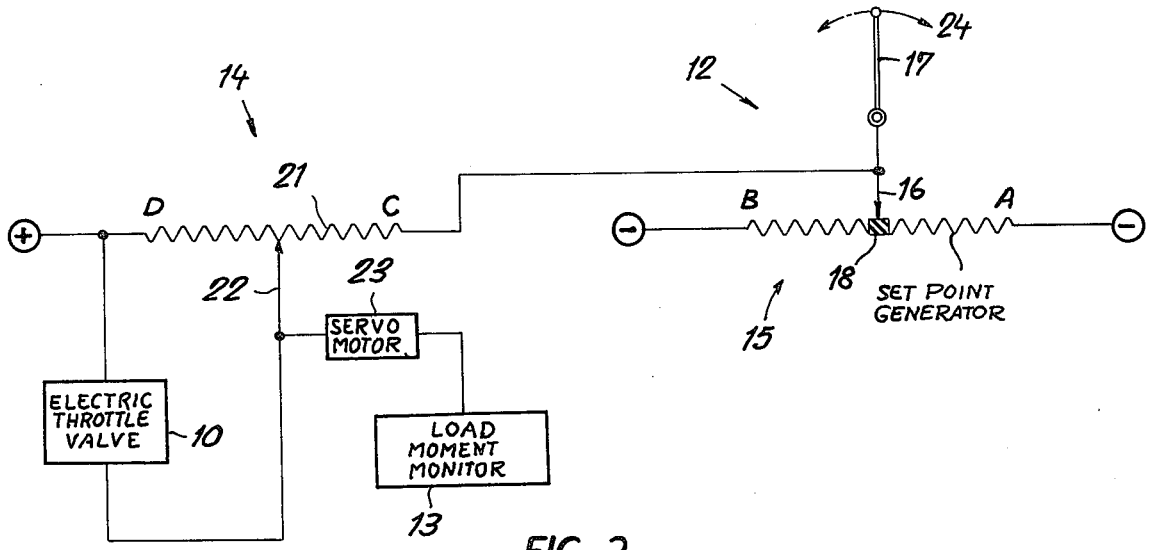
FIG. 2 is a detail of this circuit.

The control arrangement, best seen in FIGS. 1 and 2, has an operating lever represented at 17 and manually displaceable to swing the boom in the manner described.

In addition, the boom may be connected to an instantaneous position signal generator 40 which provides an input signal to a maximum permissible load indicator 41. The output of the latter is a signal representing the maximum permissible load for each instantaneous position of the boom about its pivot 33.

A pressure-electrical transducer 42, connected to the hydraulic lines of cylinder 1*a*, provides an output signal which is a function of the instantaneous actual load moment of the boom 30. The two signals are applied to a divider 43 which forms the quotient in the form of a continuous output.

Elements 40 – 43 are represented at 13 in FIGS. 1 and 2.

The quotient-forming comparator 43 can be constituted as described at chapter 15, pages 74–76 of the HANDBOOK OF TELEMETRY AND REMOTE CONTROL (McGraw-Hill Book Co., New York, 1967).

The transducer 42 can be any pressure-electrical transducer responsive to the pressure within the cylinder 1*a*. For example, the device can be a pressure detector whose membrane acts upon a strain gauge producing a continuous electrical output representing pressure and hence the load moment (see chapter 2, page 20 of PERRY'S CHEMICAL ENGINEERS' HANDBOOK, McGraw-Hill Book Co., New York, 1963).

The transducer 40 can be a position sensor whose electrical output is applied to a multiplier 41 having a transfer function which imparts to the output the function of maximum permissible load moment. Devices of this type can be found in SERVOMECHANISM PRACTICE, Ahrendt and Savant (McGraw-Hill Book Co., New York, 1960).

The crane drive comprises, in addition to the double-acting crane-displacement cylinder 1, a 4/3 -distributing valve 4 (4 port, 3 position), both output ports of which are connected to the opposite sides of the cylinder.

One of the input ports of the valve is connected by line 5 to a hydraulic pump 8 drawing fluid from a reservoir 7 while another port of the valve is connected by line 6 to the reservoir directly.

A bypass duct 9 connects the line 5 with the reservoir 7 through a control valve (setting element) which is electrically actuated and provides a variable-cross-section path between the pressure side of the pump and the reservoir. The valve 10 is continuously adjustable.

The pressure line 5 is also connected to the reservoir through a pressure-relief valve 11.

When the valve 4 is in the position shown, lines 2 and 3 leading to the cylinder 1 are blocked and the boom is held in the position which it previously assumes. Simultaneously lines 5 and 6 are blocked so that the hydraulic fluid displaced by the pump 8 is bypassed through the pressure-relief valve back to the reservoir.

When the valve body is shifted to the right, line 5 communicates with the bottom of cylinder 1 while line 6 communicates with the top thereof and hydraulic fluid flows under pressure below the piston 1*b* to swing the boom in the counterclockwise sense (FIG. 3), the fluid above the piston being returned to the reservoir via lines 3 and 6.

The rate of displacement of the boom depends upon the instantaneous position of the valve 10 which presents a variable flow cross-section in a bypass line 9 to the hydraulic fluid. When this cross-section is fully opened fluid is bypassed from the pump 5 and the rate of displacement of the boom is reduced to zero. When the flow cross-section of valve 10 is zero, the boom is displaced at a maximum rate.

Between these two positions of valve 10, the boom is displaced at a rate which is a function of the cross-section of the valve and therefore also a function of the voltage applied across its actuating coil.

When the valve member of valve 4 is displaced to the left, line 5 communicates with line 3 and lines 2 and 6 communicate with each other so that the boom is swung in the clockwise sense at a rate determined by the flow cross-section of valve 10.

The control system thus comprises the load-moment monitor 13 as described in connection with FIG. 3 which measures the instantaneous load moment of the crane boom and is effective to terminate movement thereof, when a predetermined maximum load moment for the particular boom position is achieved.

Unit 12 constitutes a set point element which is operated by the control lever 17.

According to the invention, the monitoring unit 13 has, at its output a continuous signal which is a function of the quotient of the instantaneous load moment and the maximum permissible load moment for the instantaneous position of the boom, this output signal being applied to a logic circuit 14 to which the output of the set point unit 12 is also applied, thereby controlling the setting unit 10 (valve) of the crane-boom drive. The output of unit 13 is thus a monotonic signal value in intensity with the aforementioned quotient.

The set point unit 12 can comprise, as shown in FIG. 2, a slide-type potentiometer 15 whose wiper 16 is coupled with the swingable actuating lever 17. The actuating lever 17 may be provided with a protection 19 which operates switch contacts 20 to shift the valve 4 from its intermediate position, in which it is shown and into which it can be biased by conventional springs, to one or the other extreme positions as described above to raise or lower the boom.

The potentiometer 15 comprises a pair of resistors to either side of an insulating band 18, the free ends of the resistors being connected to one terminal of a direct-current power supply. When the lever 17 is displaced about its pivot to one or the other side, the wiper 16 connects either section A or section B in series with a potentiometer 21 of the logic unit 14.

Potentiometer 21 has a wiper 22 displaceable by a servomotor 23 to which the output signal of the monitoring unit 13 is applied. Potentiometer 21 is connected as a voltage divider network across the throttle valve or setting device 10 of the crane boom drive. For this purpose the end D of the potentiometer 21 is connected to the other terminal of the source while end C thereof is connected to the wiper 16.

Assuming the system is not close to overload, a displacement of the lever 17 sharply to one side or the other from its central illustrated position in FIG. 2 will provide a maximum voltage drive across the throttle valve 10 to displace this valve into its maximum-cross section position and permit the boom to be displaced in a corresponding direction at maximum speed. However, as the load moment increases, the servomotor 23 will drive the wiper 22 to reduce the voltage applied to the valve 10 and thereby diminish the rate of displacement of the boom correspondingly.

The speed is also determined by the position of lever 17 which places a greater or lesser portion of the sections of potentiometer 15 in series with potentiometer 21. However, as the quotient approaches unit, corresponding to maximum output of the monitoring device 13, the servomotor 23 drives the wiper 22 to the extreme left and brings the valve 10 into a fully open position corresponding to zero displacement rate of the crane boom as described above. Arrow 24 represents the displacement of lever 17.

I claim:

1. In a drive for a crane having a boom, a manually actuatable unit controlling the displacement of said boom, a drive unit controlled by said manually actuatable unit for displacing said boom, and a monitoring unit for measuring the load moment on said boom, the improvement which comprises a logic element in said drive unit for controlling the speed of said boom, said monitoring unit comprising means for generating an output signal representing the quotient of the instantaneous load moment of said boom and the maximum permissible load moment for the instantaneous position thereof, and means for applying said output signal to said logic element for controlling the speed of said boom upon operation of said manually actuatable unit to reduce said speed upon increasein the amplitude of said quotient.

2. The improvement defined in claim 1 wherein said manually actuatable unit includes a lever and a potentiometer having a wiper connected with said lever.

3. The improvement defined in claim 2 wherein said logic element includes a second potentiometer connected to said wiper and provided with a further wiper, a servomotor being connected to said further wiper for displacing same in response to said output signal.

4. The improvement defined in claim 3 wherein said drive unit further comprises an electrically operated speed controller, said speed controller being connected across said second potentiometer as a voltage divider.

5. The improvement defined in claim 4 wherein said drive unit includes a hydraulic valve, a pump connected to said valve, and a hydraulic motor connected to said valve and operatively connected to said boom for displacing same upon shifting of said valve, means responsive to said lever for shifting said valve to feed hydraulic fluid from said pump to said motor, said speed controller comprising an electrically operable second valve of variable flow cross section connected to the output side of said pump for diverting fluid from said motor, the first-mentioned potentiometer being connected in circuit with the second potentiometer to energize said second valve upon displacement of said lever.

6. The improvement defined in claim 5 wherein said second potentiometer has a first terminal connected to a voltage source and a second terminal connected to the wiper of said first potentiometer having an insulating central portion and terminal portions connected to another terminal of said source, said second valve being electrically connected between the first terminal of said second potentiometer and the wiper thereof.

7. The improvement defined in claim 6 wherein said monitoring unit comprises first means responsive to the instantaneous load moment of said boom for producing a first signal, second means responsive to the instantaneous position of said boom for forming a second signal determined by the maximum permissible load moment of said boom at the instantaneous position thereof, and a quotient-forming comparator producing said output signal in proportion to the quotient of said first and second signals.

8. A method of controlling a crane boom comprising the steps of:

a. generating a first signal representing the instantaneous load moment on said boom;

b. generating a second signal representing the maximum permissible load moment of said boom at each instantaneous position thereof;

c. forming the quotient of said first and second signals and producing a monotonic output signal representing the loading of said boom;

d. generating a control signal in response to manual actuation of an element to cause displacement of said boom as a function of the displacement of said element; and e. modifying said control signal in accordance with said output signal to prevent overloading of said boom by reducing the rate of displacement of said boom as said quotient increases.

9. The method defined in claim 8 wherein said control signal controls the rate of flow of hydraulic fluid to a hydraulic motor connected to said boom.

10. The method defined in claim 9 wherein said signals are electrical.

* * * * *